United States Patent [19]

Monck et al.

[11] 4,038,760

[45] Aug. 2, 1977

[54] CROP DRYING APPARATUS

[76] Inventors: John M. Monck; Charles S. P. Monck, both of Aldern Bridge House, Newbury, Berkshire, England

[21] Appl. No.: 684,766

[22] Filed: May 10, 1976

[51] Int. Cl.[2] ..... F26B 11/02

[52] U.S. Cl. ..... 34/109; 34/130; 432/103

[58] Field of Search ..... 34/108, 109, 127, 134, 34/130, 138; 432/103, 105, 110, 118, 106

[56] References Cited

U.S. PATENT DOCUMENTS

| | | | |
|---|---|---|---|
| 1,453,711 | 5/1923 | Hoting | 34/134 |
| 1,986,548 | 1/1935 | Wolfe | 34/109 |
| 2,293,435 | 8/1942 | Johnson | 34/109 |
| 2,701,422 | 2/1955 | Stewart et al. | 34/109 |
| 2,818,657 | 1/1958 | Wolfe | 34/109 |

*Primary Examiner*—John J. Camby
*Assistant Examiner*—Henry C. Yuen
*Attorney, Agent, or Firm*—Leydig, Voit, Osann, Mayer & Holt, Ltd.

[57] ABSTRACT

Crop drying apparatus comprises a horizontal rotatable drum divided internally into a plurality of outer chambers for containing crop to be dried, and a central, axially-extending, multi-sided duct which receives an axial air flow. The inner surface of each chamber has a perforate area to permit flow of air from the duct into the chamber to dry the crop therein and the outer surface of each chamber has a perforate area to permit discharge of moisture-laden air from the chamber to the surrounding atmosphere, the inner perforate area of each chamber leading the associated outer perforate area in the normal direction of rotation of the drum. Control flaps are provided to control the air flow through the inner perforations during rotation of the drum.

16 Claims, 12 Drawing Figures

CROP DRYING APPARATUS

BACKGROUND OF THE INVENTION

1. Field of the Invention

The present invention relates to crop drying apparatus comprising a rotating crop-receiving drum through which air is passed to dry the crop.

2. Description of the Prior Art

Crop drying apparatus comprising a rotating crop-receiving drum which is connected to a source of heated drying air has been disclosed, for example in U.S. Pat. Nos. 2,780,010 and 2,983,500 and Great Britain Pat. No. 14,128, dated 1893.

Severe difficulties arise in efficiently drying relatively wet crops, such as grass, which tend to compress into a relatively dense mass within a drying drum with the result that the drying air cannot fully penetrate the mass.

The Applicants have found that these difficulties can be overcome by providing specific air flow patterns in the interior of the drum.

SUMMARY OF THE INVENTION

According to the present invention, there is provided crop drying apparatus comprising a rotatable drum mounted with its axis extending generally horizontally, means dividing the interior of the drum into a plurality of outer chambers for containing crop to be dried, and a central, axially-extending multi-sided duct having an inlet at one end portion to receive an axial air flow, doors on the outer surface of the drum, each door being associated with a respective chamber to enable filling and/or discharge of the crop into or from the chamber, the inner surface of each chamber comprising a perforate area to permit flow of air from the duct into the chamber to dry the crop therein and the outer surface of each chamber comprising a perforate area to permit discharge of moisture-laden air from the chamber to the surrounding atmosphere, and the inner perforate area of each chamber leading the associated outer perforate area in the normal direction of rotation of the drum, and means for controlling the air flow through the inner perforations during rotation of the drum.

Further according to the present invention, there is provided apparatus for drying forage crops comprising a drum having a generally horizontal axis, means for rotating the drum about its axis, means dividing the interior of the drum into at least three outer chambers for containing the crop to be dried, and a central, axially-extending, flat-walled multi-sided duct arranged to receive an axial air flow, each side of the duct defining an inner wall of each respective chamber and the peripheral wall of the drum defining an outer wall of each chamber, a door associated with each respective chamber to enable filling and/or discharge of the crop into or from the chamber, said doors being located on the outer peripheral surface of the drum, the inner wall of each chamber comprising a perforate area located adjacent a corner portion of the duct to permit flow of air from the duct into the chamber to dry the crop therein, and the outer wall of each chamber comprising a perforate area to permit discharge of moisture-laden air from the chamber to the surrounding atmosphere, and the inner perforate area leading the associated outer perforate area in the normal direction of rotation of the drum, flaps for controlling the air flow through the inner perforate areas, said flaps being located inside the duct adjacent the corner portions thereof, and means for operating the flaps during rotation of the drum.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENTS

Figure 1:
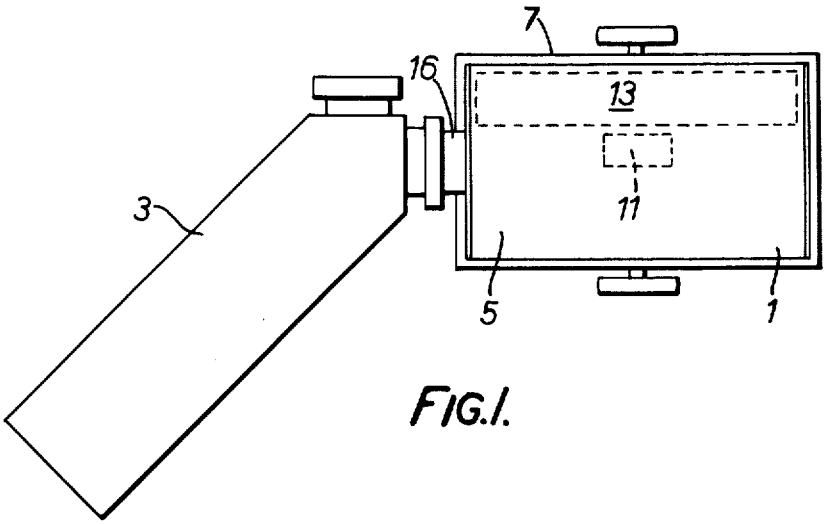
FIG. 1 is a plan view of crop drying apparatus in accordance with the invention.

As shown in the drawings, the crop drying apparatus comprises a mobile crop collecting and/or dehydrating unit 1 arranged for connection to a gaseous fluid heating unit 3 which produces a large mass flow of hot gas. The collecting and/or dehydrating unit comprises a cylindrical drum 5 mounted for rotation about its axis in a partially cylindrical cradle 6 supported on a wheeled or fixed chassis 7. A section 6A of the cradle is detachable for a purpose described hereafter.

The interior of the drum 5 is divided by longitudinally-extending partitions into a substantially triangular cross-sectioned axial duct 9 and three crop-receiving chambers *9a*, *9b*, and *9c* of substantially equal volume and arranged around the duct 9. Crops can be fed into the chambers *9a*, *9b* and *9c* through respective inlet apertures 11 in the cylindrical wall of the drum 5 and can be discharged from the chambers through respective discharge apertures 13 extending longitudinally along substantially the entire length of the cylindrical wall of the drum 5. The inlet apertures 11 can be closed by doors in the form of shutters 11A which are lockable in a closed position but which are spring biased into an open position, and the discharge apertures 13 can be closed by doors in the form of shutters 13A which can be locked in a closed position.

Figure 8:
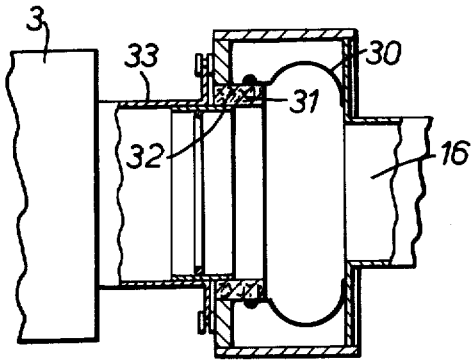
FIG. 8 is a longitudinal cross-section through an outlet from a heater unit of the apparatus.

Extending axially from one end of the drum 5 is a conduit 16 for communication with a hot gas delivery duct 33 (FIG. 8) of the unit 3. Preferably the delivery duct 33 of the unit 3 includes a flexible collar 30 mounted on a ring 31 rotatable with the conduit 16 when the drum 5 rotates. A seal 32 is provided between the ring 31 and the delivery duct 33 of the unit 3 to minimize loss of hot gasses at the joint. The conduit 16 is in communication with the duct 9 so that hot gas, suitably air, is fed from the unit 3 into the duct 9.

Figure 5A:
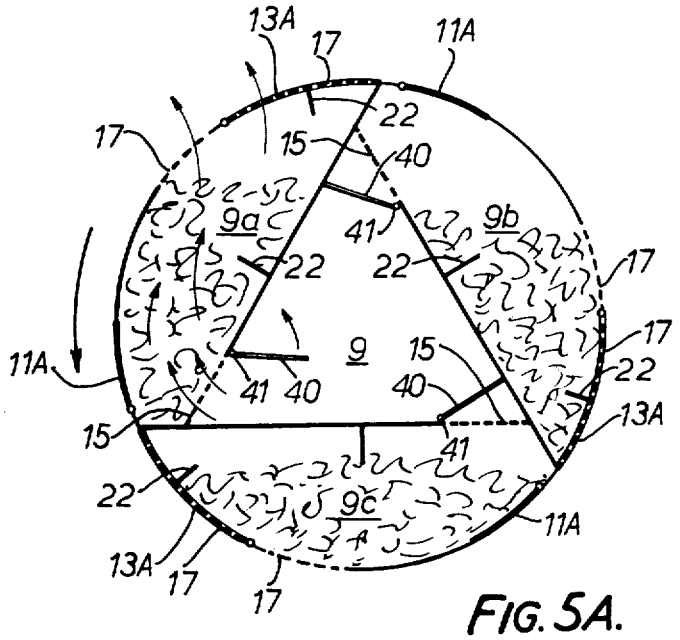
FIG. 5A is a transverse section through the drum to indicate the movement of crops and hot air during drying.
Figure 5B:
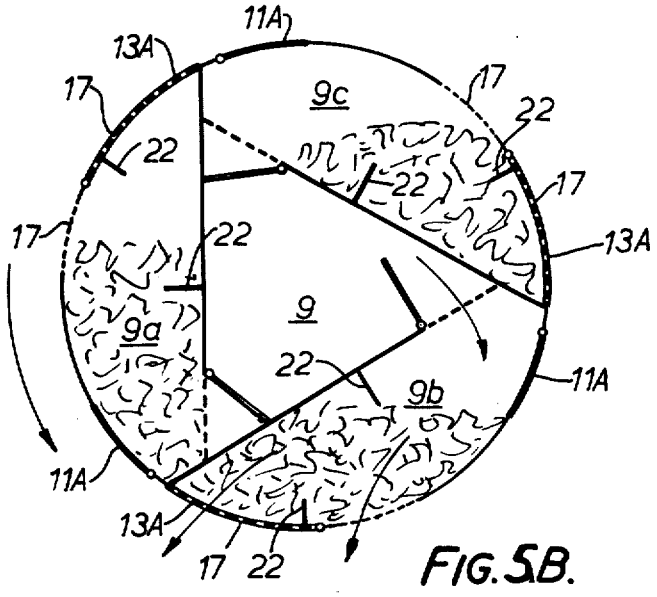
FIG. 5B is a transverse section, similar to FIG. 5A of a modified form of drum.

As shown in FIGS. 5A and 5B the duct 9 has three sets of perforations 15, one set of perforations 15 being associated with each respective crop-receiving chamber whereby hot air fed into the duct from the unit 3 is passed into each of the three chambers 9*a*, 9*b* and 9*c* to dry crops therein, the air being subsequently discharged through respective sets of perforations 17 in the cylindrical wall of the drum 3. Each set of perforations 15 is provided in a respective wall of the duct 9 adjacent to a corner portion thereof and the corresponding set of perforations 17 is provided in the cylindrical wall of the drum 5 in a longitudinal edge portion of its associated chamber remote from the set of perforations 15. Preferably, each set of perforations 15 is formed by an upstream and downstream group of perforations, the open area of the upstream group being larger than that of the downstream group in order to provide the required airflow distribution along the length of the duct.

In this arrangement each set of perforations 17 follows its associated set of perforations 15 in the direction of rotation of the drum 5.

A row of rake spikes 22 mounted externally on each wall of the duct 9 extends longitudinally of each chamber to assist in moving the crops therein during drying. A second set of spikes 22 may be mounted internally on the cylindrical wall of the drum for the same purpose. The length and spacing of the spikes is dependent on the crop being dried. The spikes 22 should preferably not extend across more than ⅓ the width of the chamber, otherwise bridging may occur.

Figure 3:
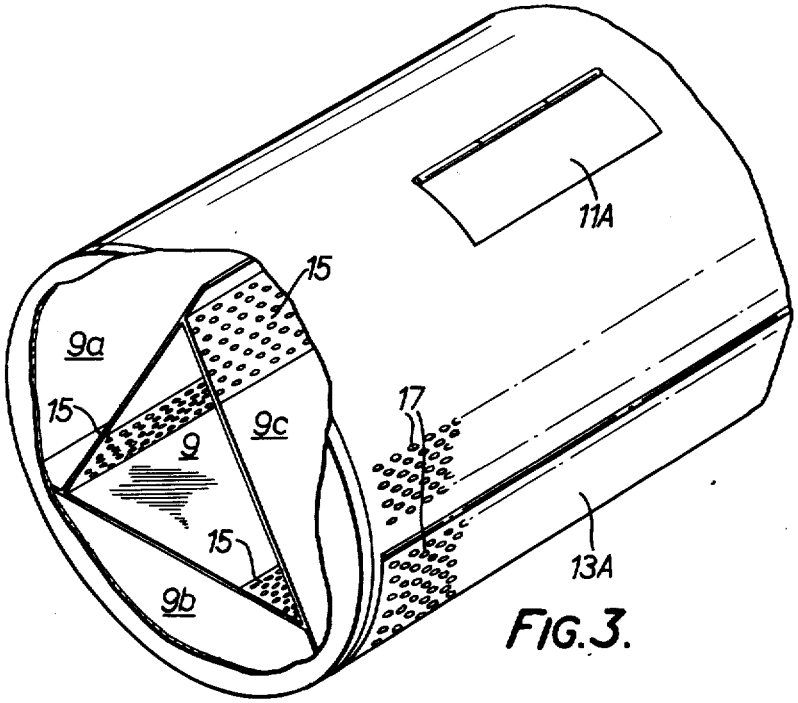
FIG. 3 is a fragmentary perspective view, to an enlarged scale, of a drum for the apparatus shown in FIGS. 1 and 2.

A set of control flaps 40 (FIGS. 4 and 5) is positioned in the duct 9, each flap being pivoted at one edge of a shaft 41 and extending along the length of the duct 9; the flaps have been omitted from FIG. 3 for the sake of clarity. Each of the flaps 40 is arranged to close a respective corner portion of the duct 9, so as to prevent hot air from passing from the duct 9 and through the associated set of perforations 15 into the corresponding drying chambers. Movement of the flaps 40 is controlled by a cam system. The cam system is such that substantially only one flap 40 is open at any one time, although a slight overlap may occur when one flap is closing and another flap is opening.

When the drum is positioned as shown in FIG. 5A, the flap 40 corresponding to the chamber 9*a* is opened, and hot air passes into the chamber 9*a* until the drum rotates into the position shown in FIG. 5B whereat the flap 40 of the chamber 9*a* is closed and the flap 40 of the chamber 9*b* is opened. Preferably the flap 40 of the chamber 9*a* is opened when the adjacent wall of the duct 9 is inclined at approximately 50° to the horizontal, at which time the crop begins to slide downwardly along that wall, and the flap 40 begins to close when the adjacent wall of the duct 9 is approximately vertical. In this manner drying in the chamber 9*a* during rotation of the drum from the position shown in FIG. 5A into the position shown in FIG. 5B is provided by a fluidized bed, in which the pressure of air tends to cause the crop to float in the air stream, thus promoting vigorous mixing as well as increasing the surface area of the crop exposed to the air stream; drying in the chamber 9*b* during rotation of the drum from the position shown in FIG. 5B is essentially thin layer bed drying in which the crop remains static across the outer perforations 17, a high pressure being established within the chamber thus improving the efficiency of drying. By this arrangement the crop in each chamber is subjected alternately to a fluidized bed system and thin layer system of drying.

Figure 7:
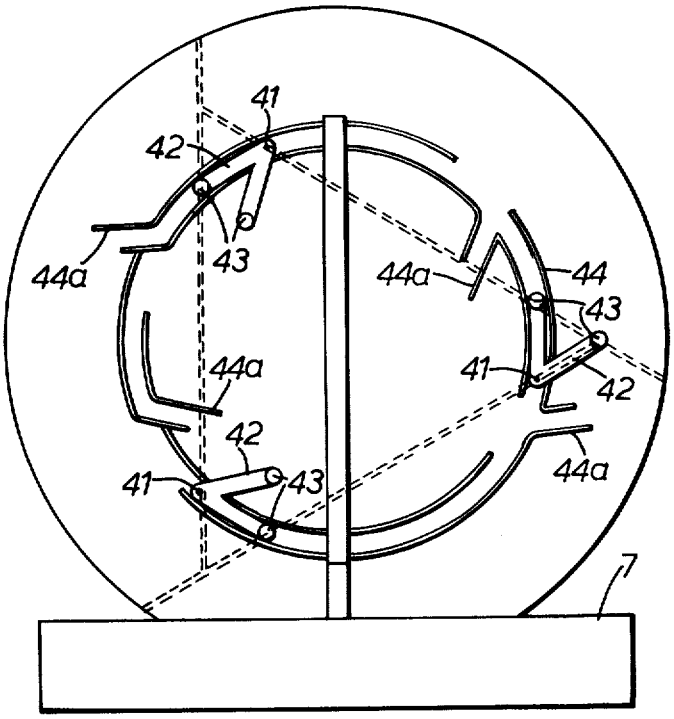
FIG. 7 is an end elevation of the drum, and showing one form of cam system for operating air control flaps of the drum.

One form of cam system for controlling movement of the flaps 40 is shown in FIG. 7. The shaft 41 of each flap 40 is rigid with a pair of relatively inclined arms 42, a follower roller 43 being carried by each arm 42. The rollers 43 are engageable in a stationary cam track 44 mounted on this chassis 7. When the drum 5 rotates, the co-operation between the rollers 43 and the track 44 causes the flaps 40 to be periodically opened and closed. Each flap is opened and closed twice during each revolution of the drum and is open between for ⅓ and ⅔ of each revolution; preferably each flap is only open for a total period of about ⅓ of a revolution, this being provided by two opening periods each of 1/6 of a revolution.

As particularly shown in FIG. 7, the track 44 is of generally circular profile but is composed of a plurality of segments each preceded by an inclined guide portion 44*a*. The two rollers 43 associated with each flap 40 are alternately engaged in the track 44; when one roller is engaged in one segment of the track 44, the other roller and its arm 42 is positioned radially internally or externally of the segment. Upon reaching the end of the segment the roller which was disengaged from the track engages the guide portion 44*a* of the following segment and is guided thereby into the track; this action causes the two arms 42 to pivot so that the roller which was formerly engaged with the track, is disengaged from the track. In this manner the associated flap 40 is pivoted from an open to a closed position or vice-versa.

The cam track 44 shown is arranged to open each flap 40 twice per revolution of the drum, and is adjustable to vary the angular position at which each flap 40 opens during rotation of the drum thereby enabling the drum to be used with different crops. As will be apparent, by suitably adjusting the cam track 44, the preferred flap control programme described with reference to FIG. 7 can be achieved.

The open area of the perforations 15 is critical for a given air flow to ensure an adequate pressure in the duct 9 to facilitate even drying along the length of the drum and between individual chambers 9*a*, 9*b*, 9*c*. Preferably, the air-flow speed across the perforations 15 is at least about 2,500 ft/min, although it is not necessary for the air-flow speed to be greater than about 5,000 ft/min. The open area of the perforations 17 on the cylindrical wall of the drum is critical to prevent crop building up on the perforated portion during drying, the hole size on the perforations 17 is also critical to avoid excessive crop loss. Each of the perforations 17 is preferably between about 0.06 and 0.1 ins, and more particularly 0.069 and 0.095 ins., the open area of each set of perforations 17 is at least 30% of the total surface area of the set, the width of each set of perforations 17 (measured along the surface of the drum) is at least 1½ ft. preferably 3 ft., and the total open area formed by the perforations 17 is between about 1/10 and ⅓ of the surface area of the drum.

Figure 4A:
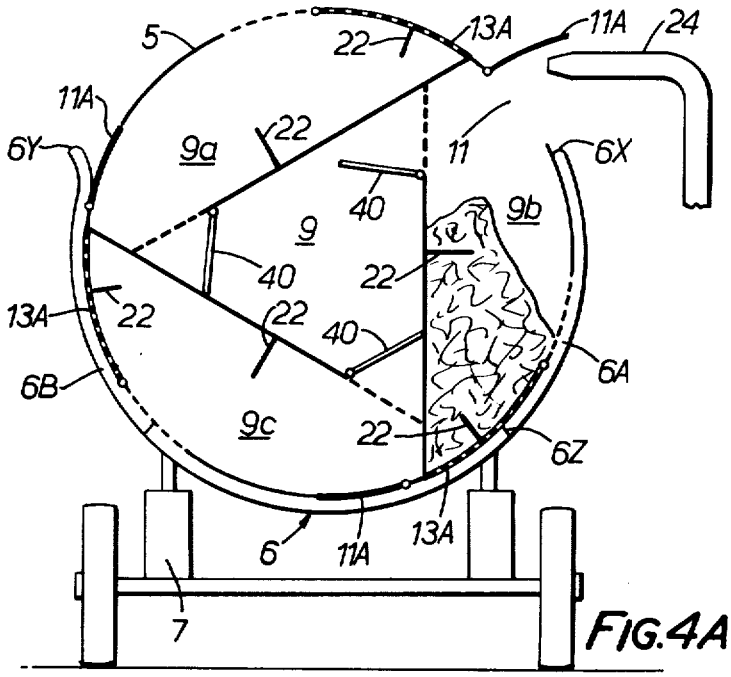
FIGS. 4A and 4B are transverse sections through the drum during filling and emptying thereof respectively.
Figure 6A:
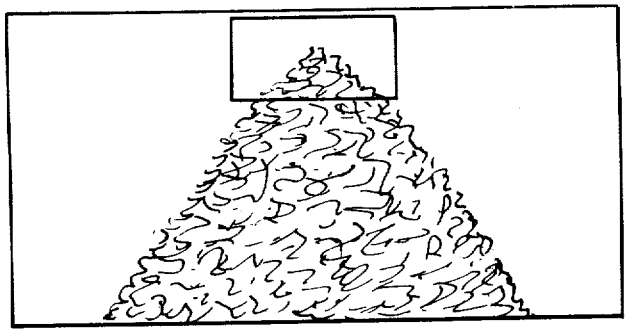
FIGS. 6A, 6B and 6C show schematically the disposition of crops in a crop-receiving chamber of the drum when filled and during successive revolutions of the drum.
Figure 6B:
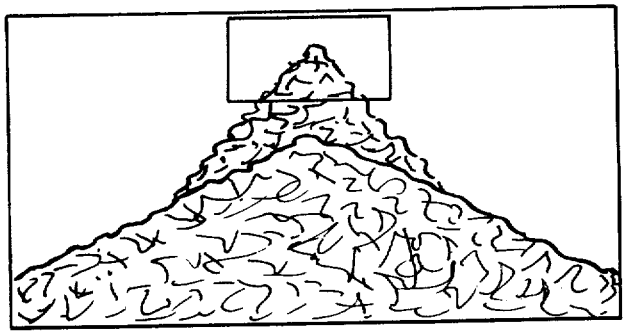
Figure 6C:
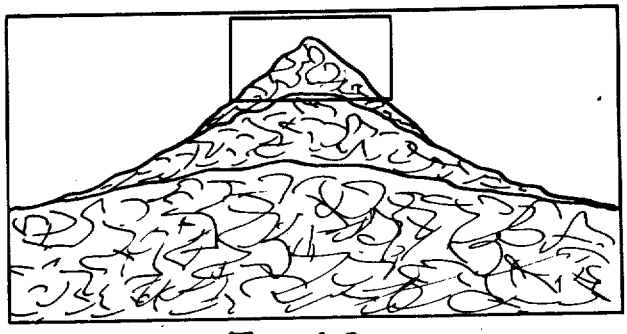

In operation the collecting and/or dehydrating unit 1 is drawn through, for example a hay field, by a tractor or other vehicle, the shutters 11A being unlocked but are prevented from opening the cradle 6. The drum 5 is rotated anticlockwise (as viewed in FIG. 4) until a shutter 11A has passed the upper edge 6*x* of the section 6A of the cradle and is free to open under its spring bias. Crop is fed into the crop-receiving chamber associated with the open shutter by a concurrent reaper, the head 24 of which is shown in FIG. 4. When this chamber is filled with crop, the crop falls in a conical heap, as shown diagrammatically in FIG. 6A and the drum 5 is rotated anti-clockwise through one third of a revolution. The open shutter 11A upon connecting the leading edge 6y of the cradle 6 is closed and the shutter 11A of the following crop-receiving chamber 9b is opened when it passes the edge 6y of the cradle. In this manner, all three chambers can be filled with crop. Due to rotation of the drum 5 however, the crop in the first chamber to be filled will have settled, so that the first chamber can be filled with additional crop (as shown in FIGS. 6B and 6c) ) when its shutter 11A passes the edge 6y of the cradle during two subsequent revolutions of the drum 5. The remaining chambers can likewise be filled with additional crop.

The unit 1 is then towed to the heating unit 3 and the conduit 16 is placed into communication with the hot gas delivery duct 33 thereof. Hot gas is directed into the duct 9 and is fed, via the sets of perforations 15, through the crop in the chambers whilst the drum is rotating. The speed of rotation of the drum will affect the drying time and segregation of the crop; if the speed of rotation is too low the drying will be uneven and lumps of incompletely dried crop may result. Preferably the drum is rotated at about 2 rpm. When the crop being dried is grass, the mass flow rate and temperature of the hot gas are so adjusted that the exhaust temperature of the gas discharged from the drum is less than 200° F, preferably less than 150° F. The inlet temperature of the gas is as high as possible at the beginning of a drying cycle but is reduced to about 300° F by the end of the cycle (i.e. when the crop has less than 10% moisture). Suitably, such control of the inlet temperature is provided by sensing the exhaust temperature of the gas and by reducing the inlet temperature in response to increase of the exhaust temperature as drying takes place. In this manner, the drying efficiency is improved, and deterioration of the crop due to excessive drying is prevented.

In the embodiments hereinbefore described warm air is discharged to atmosphere through the sets of perforations 17. To improve the efficiency of the process a duct can be mounted on the outer surface of the drum 5 over each set of perforations 17 or mounted statically on the chassis 7 to collect exhaust air and lead it back to the heating unit 3 for recycling.

Figure 4B:
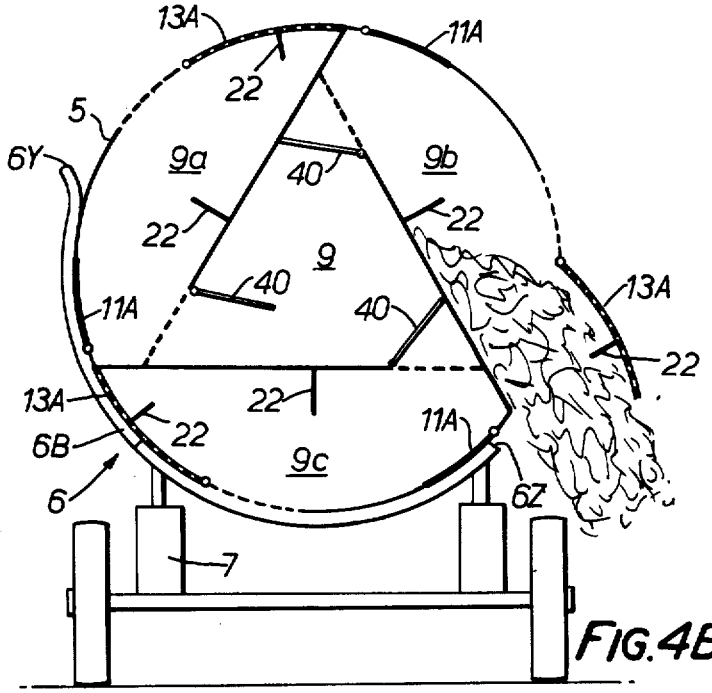

When drying is completed the unit is towed away. The section 6A of the cradle 6 is removed and the shutters 13A of the discharge apertures 13 are unlocked. To discharge the crop from the drum, the drum is rotated anticlockwise and as each shutter 13A passes the trailing edge 6z of the cradle 6, it falls open under the influence of gravity thus permitting the crop to discharge through the aperture 13 as shown in FIG. 4B.

Figure 2:
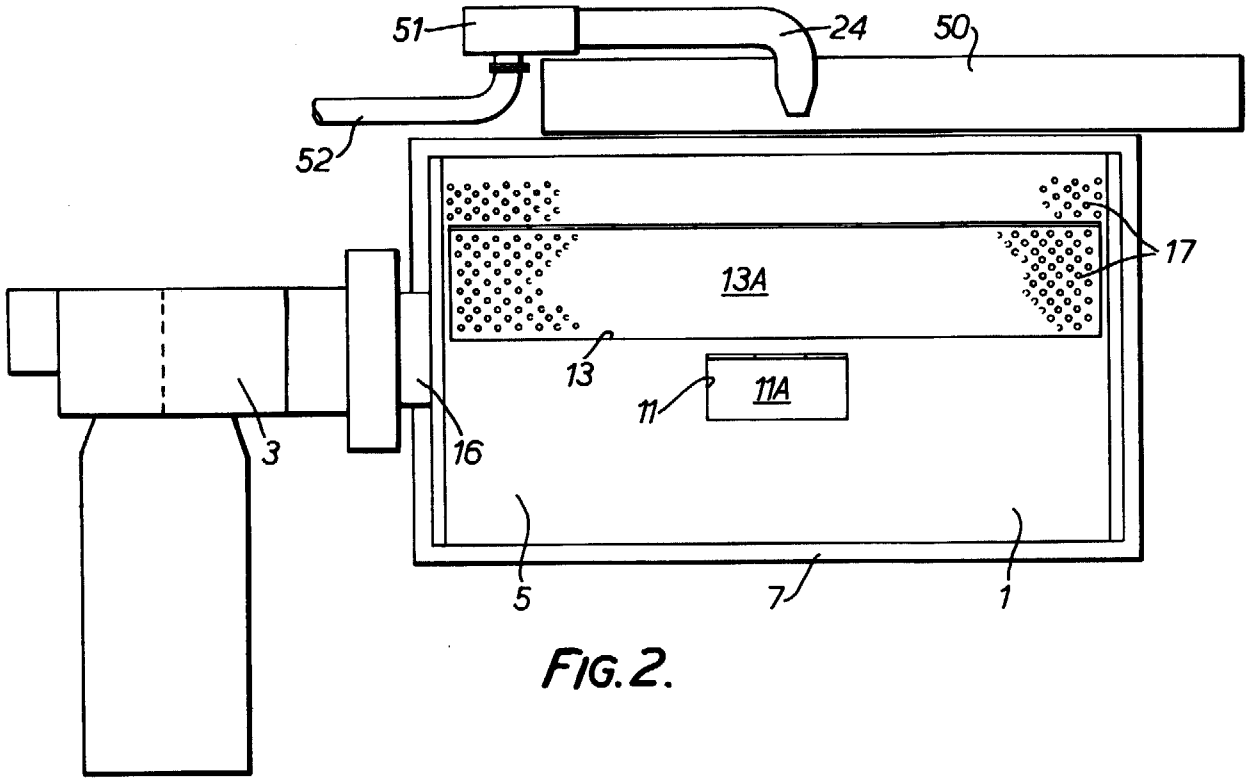
FIG. 2 is a plan view of a modified form of the crop drying apparatus shown in FIG. 1.

In the apparatus shown in FIG. 2 the collecting and/or dehydrating unit 1 is fixed to the heating unit 3. A conveyor 50 extends along the length of the drum 5 at one side of the drum, which delivers crop to a pneumatic conveying duct 51. Crop is transported from the field and loaded into the drum as hereinbefore described by means of the conveyor and duct. When drying is completed, the crop is emptied onto the conveyor 50 and is fed to the duct 51 which conveys the crop to store using a second duct 52.

In a modified arrangement to enable the drum 5 to be filled without the need for the drum being moved into the field a section 6B of the cradle 6 is also removable, the section 6B being located at the opposite side of the cradle to the section 6A. The crop is brought to a single loading position by, for example, a tipping trailer. The crop is loaded into each crop-receiving chamber through its assembled shutter 13A at the side of the drum opposite to that at which the crop is discharged. For this purpose the section 6B of the cradle 6 is removed and the drum is rotated clockwise so that the shutters 13A open when they pass the trailing edge of the cradle 6. The crop is loaded through the thus-open discharge aperture 13 using, for example, a tractor mounted fore-loader. When the crop-receiving chamber has been filled the drum is further rotated clockwise to bring the following crop-receiving chamber into the loading position. The shutter 13A of the filled chamber closes under the influence of gravity as it passes top dead centre, and is prevented from reopening by the section 6A of the cradle 6, this section being retained in position during loading.

This process is repeated until the drum 5 has been filled. The shutters 13A are then fastened to prevent them from reopening during rotation of the drum 5. The drum is rotated anticlockwise during drying and the dried crop can be discharged from the chambers as described before.

Although as particularly described the duct is of triangular cross-section, the duct may be of other flat walled multi-sided construction; for example the duct may be of rectangular cross-section; likewise there may be more than three crop-receiving chambers.

We claim:

1. Crop drying apparatus comprising a rotatable drum mounted with its axis extending generally horizontally, means dividing the interior of the drum into a plurality of outer chambers for containing crop to be dried, and a central, axially-extending, multi-sided duct having an inlet at one end portion to receive an axial air flow, doors on the outer surface of the drum, each door being associated with a respective chamber to enable filling or discharge of the crop into or from the chamber, each chamber having means defining an inner perforate area to permit flow of air from the duct into the chamber to dry the crop therein and means defining an outer perforate area to permit discharge of moisture-laden air from the chamber to the surrounding atmosphere, and the inner perforate area of each chamber leading the associated outer perforate area in the normal direction of rotation of the drum, and means for controlling the air flow through the inner perforate area during rotation of the drum.

2. Apparatus according to claim 1, wherein the duct is of generally triangular cross-section.

3. Apparatus according to claim 2, further comprising rakes extending into the interior of each chamber.

4. Apparatus according to claim 1, wherein each perforation of the outer perforate areas has a diameter of between about 0.06 ins. and 0.1 ins, and each outer perforate area has an open area of at least 30%.

5. Apparatus according to claim 1, wherein the total open area of the outer perforate areas is between about 1/10 and ⅓ of the peripheral surface area of the drum.

6. Apparatus according to claim 1, wherein each inner perforate area is composed of first and second groups of perforations, the first group being arranged upstream of said second group with respect to the direction of air flow through the duct, and the open area of the first group being greater than that of the second group.

7. Apparatus according to claim 1, wherein the means for controlling the air flow through the inner perforate areas comprises flaps mounted in the duct adjacent the inner perforate areas.

8. Apparatus according to claim 7, further comprising a generally circular cam track, and cam followers engageable with the track and linked to the flaps, said followers being movable around the track during rotation of the drum to effect opening and closing movements of the flaps.

9. Apparatus according to claim 8, wherein the cam track is pivotal about the axis of the drum into a selected angular position and the cam track is so arranged as to permit rotation of the drum in either direction.

10. Apparatus according to claim 7, wherein the flaps are controlled so that during each revolution of the drum, air flows into each chamber for a total period equivalent to between about ⅓ and ⅔ of a revolution.

11. Apparatus according to claim 10, wherein the flaps are controlled so that air flows into each chamber in two discrete periods.

12. Apparatus according to claim 11, wherein each of said discrete periods extends over about 1/6 of a revolution.

13. Apparatus according to claim 10, wherein the duct defines an inner surface of each chamber, and each flap is controlled so that when its associated chamber is moving downwardly with its said inner surface inclined at such an angle that the crop begins to slide along the said inner surface, the flap is opened to permit air flow into the chamber and the flap is closed when the said inner surface is approximately vertical, the flap being opened again during upwards movement of the chamber.

14. Apparatus for drying forage crops comprising a drum having a generally horizontal axis, means for rotating the drum about its axis, means dividing the interior of the drum into at least three outer chambers for containing the crop to be dried and a central, axially-extending, flat-walled multi-sided duct arranged to receive an axial air flow, each side of the duct defining an inner wall of each respective chamber and the peripheral wall of the drum defining an outer wall of each chamber, a door associated with each respective chamber to enable filling or discharge of the crop into or from the chamber, said doors being located on the outer peripheral surface of the drum, the inner wall of each chamber comprising an inner perforate area located adjacent a corner portion of the duct to permit flow of air from the duct into the chamber to dry the crop therein and the outer wall of each chamber comprising an outer perforate area to permit discharge of moisture-laden air from the chamber to the surrounding atmosphere, and the inner perforate area leading the associated outer perforate area in the normal direction of rotation of the drum, flaps for controlling the air flow through the inner perforate areas, said flaps being located inside the duct adjacent the corner portions thereof, and means for operating the flaps during rotation of the drum.

15. Apparatus according to claim 14, wherein the means for rotating the drum is operative to rotate the drum at a speed of about 2 rev/min.

16. Apparatus according to claim 14, further comprising means for producing a flow of hot air through the duct, such that the air flow speed across the perforations of the inner perforate area is at least about 2,500 ft./min.

* * * * *